US007415342B2

(12) United States Patent
Tamai et al.

(10) Patent No.: US 7,415,342 B2
(45) Date of Patent: Aug. 19, 2008

(54) FUEL DELIVERY CONTROL SYSTEM

(75) Inventors: Goro Tamai, West Bloomfield, MI (US); Birendra P. Bhattarai, Novi, MI (US); Tony T. Hoang, Warren, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 367 days.

(21) Appl. No.: 11/211,177

(22) Filed: Aug. 24, 2005

(65) Prior Publication Data

US 2007/0050119 A1 Mar. 1, 2007

(51) Int. Cl.
*F02D 3/04* (2006.01)

(52) U.S. Cl. ..... 701/93; 318/139

(58) Field of Classification Search ..... 701/93; 318/139, 140; 180/65.2, 65.3, 65.4; 123/338; 290/14, 19, 40 C See application file for complete search history.

(56) References Cited

U.S. PATENT DOCUMENTS

| | | | | |
|---|---|---|---|---|
| 3,690,305 | A * | 9/1972 | Shimada et al. | 123/325 |
| 4,944,199 | A * | 7/1990 | Okino et al. | 477/54 |
| 6,102,831 | A * | 8/2000 | Wakahara et al. | 477/169 |
| 6,307,277 | B1 * | 10/2001 | Tamai et al. | 290/40 C |
| 6,334,835 | B1 * | 1/2002 | Tanaka et al. | 477/205 |
| 6,742,614 | B2 * | 6/2004 | Morimoto et al. | 180/65.2 |
| 6,939,265 | B2 * | 9/2005 | Rustige et al. | 477/84 |

* cited by examiner

*Primary Examiner*—Dalena Tran

(57) ABSTRACT

A fuel delivery control system includes a vehicle speed sensor that generates a vehicle speed signal and an engine rotational speed sensor that generates an engine rotational speed signal. A control module calculates at least one of an accelerator release delay period and a brake depression delay period based on the vehicle speed signal and the engine rotational speed signal and deactivates fuel delivery to said engine after waiting at least one of the accelerator release delay period after the accelerator pedal is released and the brake depression delay period after the brake pedal is depressed.

20 Claims, 6 Drawing Sheets

FUEL DELIVERY CONTROL SYSTEM

FIELD OF THE INVENTION

The present invention relates to vehicle control systems and, more particularly, to a fuel delivery control system.

BACKGROUND OF THE INVENTION

To improve fuel economy, fuel delivery to an engine in a hybrid or conventional powertrain vehicle may be deactivated during vehicle deceleration. The vehicle engine, which delivers torque to the wheels, does not produce propulsion torque when fuel is deactivated. During fuel deactivation, the vehicle engine may be back driven by the wheels.

Traditionally, fuel is deactivated when the vehicle is decelerated. While this system improves fuel economy, it may also cause degraded drivability. When the vehicle undergoes short periods of deceleration and acceleration, fuel is deactivated and reactivated in succession. Rapid intervals of fuel deactivation and activation may cause driveline disturbance and degraded drivability.

When the vehicle is decelerated after a transmission up-shift, fuel deactivation in the traditional system may occur and the transmission may be immediately down-shifted. A transmission up-shift followed by an immediate fuel deactivation and transmission down-shift cause driveline disturbance and degraded drivability.

SUMMARY OF THE INVENTION

Accordingly, the present invention provides a fuel delivery control system in a vehicle having an engine, an accelerator pedal, and a brake pedal. The fuel delivery control system includes a vehicle speed sensor that generates a vehicle speed signal and an engine rotational speed sensor that generates an engine rotational speed signal. A control module calculates at least one of an accelerator release delay period and a brake depression delay period based on the vehicle speed signal and the engine rotational speed signal and deactivates fuel delivery to the engine after waiting at least one of the accelerator release delay period after the accelerator pedal is released and the brake depression delay period after the brake pedal is depressed.

In one feature, the control module deactivates fuel delivery after waiting a predetermined fuel delivery delay period after fuel delivery to the engine is activated.

In other features, the control module deactivates fuel delivery during at least one of a predetermined accelerator release window period after the accelerator pedal is released and a predetermined brake depression window period after the brake pedal is depressed.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
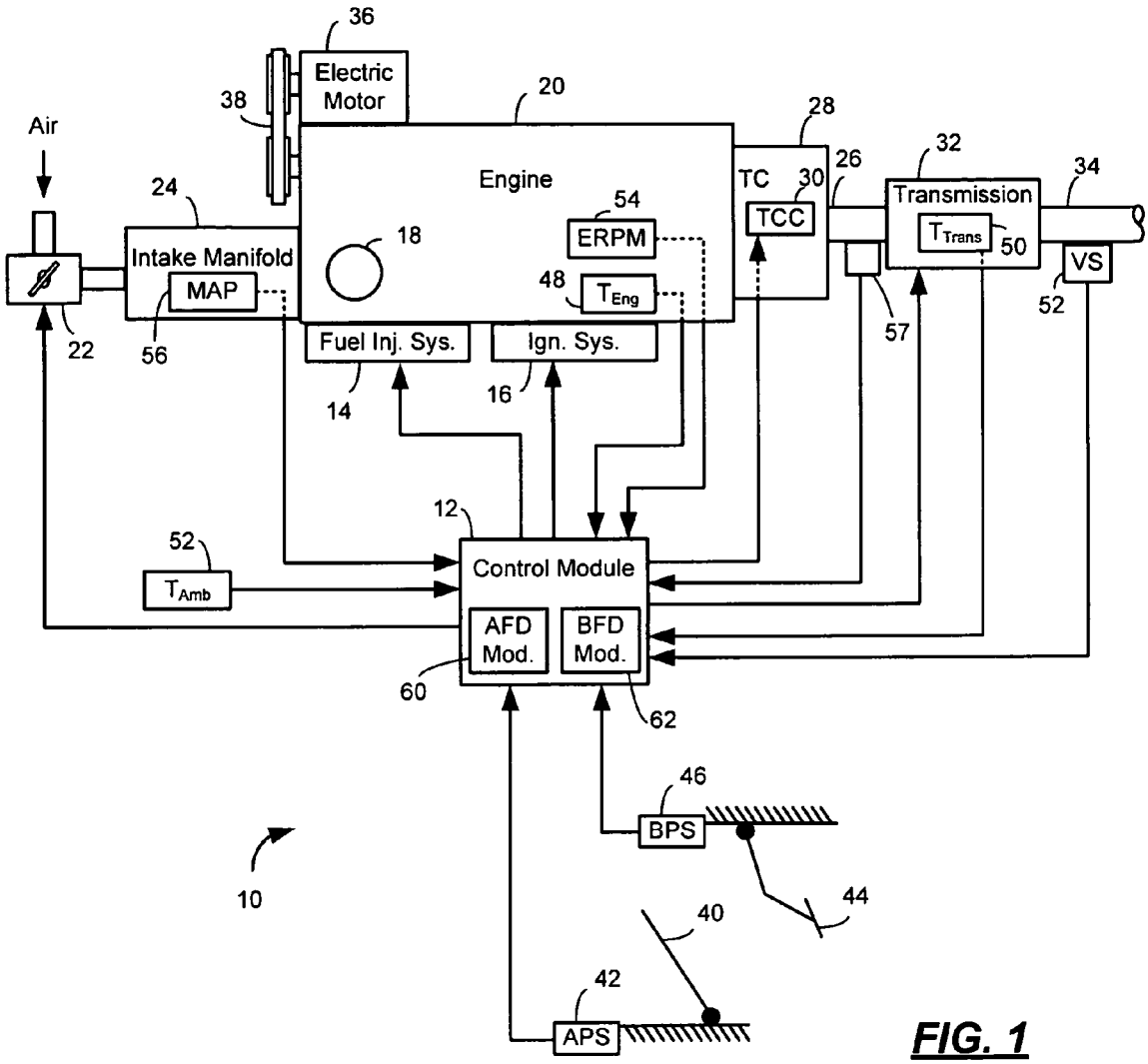
FIG. 1 is a schematic illustration of an exemplary hybrid vehicle according to the present invention.

The following description of the preferred embodiment(s) is merely exemplary in nature and is in no way intended to limit the invention, its application, or uses. For purposes of clarity, the same reference numbers will be used in the drawings to identify similar elements. As used herein, the term module refers to an application specific integrated circuit (ASIC), an electronic circuit, a processor (shared, dedicated, or group) and memory that execute one or more software or firmware programs, a combinational logic circuit, and/or other suitable components that provide the described functionality.

Referring now to FIG. 1, a fuel deactivation control system 10 for a hybrid vehicle is shown. As can be appreciated, the control system 10 may also be implemented in a conventional or non-hybrid vehicle. A control module 12 controls a fuel injection system 14 with one or more fuel injectors (not shown) and an ignition system 16 to selectively deliver fuel and spark to at least one cylinder 18 of an engine 20. The control module 12 deactivates fuel delivery to the engine 20 by deactivating fuel delivery to the at least one cylinder 18. In some implementations, deactivation is performed by activation and deactivation of intake and/or exhaust valves. When fuel delivery to the at least one cylinder 18 is deactivated, the fuel injector for the cylinder 18 is deactivated and spark is not delivered to the cylinder 18.

When fuel and spark are delivered, the engine 20 produces torque that is transferred from the engine 20 to a transmission input shaft 26 through a torque converter 28 with a torque converter clutch (TCC) 30. The transmission input shaft 26 drives a transmission 32 that in turn transfers torque to a driveline. The driveline, which includes a drive shaft 34, drives wheels (not shown) of the vehicle. When fuel delivery is deactivated, the engine 20 does not produce propulsion torque and may be back-driven by the driveline through the transmission 32, transmission input shaft 26, and torque converter 28.

The engine 20 is coupled with an electric motor 36 via a belt-alternator-starter system 38. The electric motor 36 may also be coupled to the engine by a chain drive, a clutch system, or other device. The electric motor 36 supplements torque produced by the engine 20. In a conventional powertrain vehicle, torque production is not supplemented by an electric motor 36.

An accelerator pedal 40 is operated by a driver during use. An accelerator position sensor 42 senses a position of the accelerator pedal 40 and generates an accelerator position signal (APS) that is received by the control module 12. The control module 12 controls a throttle 22 that regulates the flow of air into the engine 20 through an intake manifold 24. When the accelerator pedal 40 is depressed, the control module 12 accelerates the vehicle by opening the throttle 22 to increase air pressure in the intake manifold 24, and by providing sufficient fuel and spark to the engine 20 to meet a desired air/fuel ratio.

A brake pedal 44 is also operated by the driver during use. A brake pressure sensor 46 senses a pressure applied to the brake pedal 44 and generates a brake pressure signal (BPS) that is received by the control module 12. Alternatively, a brake position sensor may be used in place of the brake pressure sensor. The brake pedal 44 controls a brake system (not shown).

The control module 12 monitors thermal signals generated by thermal sensors. The control module 12 receives an engine temperature signal ($T_{Eng}$) generated by an engine temperature sensor 48. $T_{Eng}$ may correspond to an engine coolant temperature. The control module 12 receives a transmission temperature signal ($T_{Trans}$) generated by a transmission temperature sensor 50. $T_{Trans}$ may correspond to a transmission oil temperature. The control module 12 receives an ambient temperature signal ($T_{Amb}$) that is generated by an ambient temperature sensor 52. Upon a cold engine start, $T_{Eng}$ and $T_{Trans}$ are initially about equal to $T_{Amb}$ and will increase to normal operating temperatures as the engine is operated.

The control module 12 receives a vehicle speed signal (VS) that is generated by a vehicle speed sensor 52 based on the rotational speed of the driveshaft 34. The vehicle speed sensor 52 may alternately be connected to other vehicle components, such as the wheels, the transmission 32, or other suitable components. The control module 12 receives an engine rotational speed signal (ERPM) that is generated by an engine speed sensor 54 based on a rotational speed of the engine. The control module 12 receives a transmission input shaft rotational speed signal that is generated by a transmission input shaft rotational speed sensor 57 based on a rotational speed of the transmission input shaft. The control module 12 receives a manifold absolute pressure signal (MAP) that is generated by a manifold absolute pressure sensor 56 based on the absolute pressure within the intake manifold 24. When the vehicle decelerates, ERPM, VS, and MAP decrease over time.

The control module 12 controls a TCC state and monitors a TCC slip rate signal ($TCC_{Slip}$) that is calculated based on ERPM and the transmission input shaft rotational speed signal. $TCC_{Slip}$ is calculated as the difference between ERPM and the rotational speed of the transmission input shaft 26. When the engine 20 is providing torque to the transmission 32, ERPM may be greater than the rotational speed of the transmission input shaft 26, resulting in a positive $TCC_{Slip}$. When the engine 20 is back-driven by the driveline, the rotational speed of the transmission input shaft 26 may be greater than ERPM, resulting in a negative $TCC_{Slip}$.

The control module 12 also controls the state of the TCC 30. When the TCC 30 is in a lock state, the torque converter 28 is locked and ERPM is equal to the rotational speed of the transmission input shaft 26. $TCC_{Slip}$ is 0 when TCC 30 is in the lock state. When TCC 30 is in the lock state or when $TCC_{Slip}$ is low, the engine 20 is sufficiently coupled to the driveline such that the driveline will back drive the engine 20 when fuel delivery to the engine is deactivated.

The control module 12 controls the shifting of the transmission 32 based on VS, ERPM, and APS. In general, the control module 12 up-shifts and down-shifts the transmission to accelerate the vehicle based on APS. The control module 12 does not deactivate fuel delivery when the transmission 32 has recently been shifted. As discussed below, the control module 12 inhibits a transmission up-shift when the accelerator pedal has been quickly released, based on the vehicle speed, ERPM, and transmission shift pattern.

The control module 12 controls the ignition system 16 to deliver spark to the at least one cylinder 18 of the engine 20. The control module 12 determines a point during a piston stroke to deliver spark to the cylinder 18. The control module 12 may deliver spark at an optimal point during the piston stroke to produce the maximum amount of torque. The control module 12 may also deliver spark at a point after the optimal point. When spark is delivered after the optimal point, the engine produces less than the maximum amount of torque. The time interval between the optimal point and the point at which spark is delivered is a spark offset. As the spark offset increases, torque production decreases. To facilitate a smooth transition from torque production, when fuel delivery is activated, to no torque production, when fuel delivery is deactivated, the spark offset may be increased immediately prior to fuel delivery deactivation.

The control module 12 includes an accelerator-triggered fuel deactivation module (AFD Mod.) 60 and a brake-triggered fuel deactivation module (BFD mod.) 62. The control module generates event signals that are received by the AFD Mod. 60 and BFD Mod. 62. The control module 12 generates an accelerator release signal when APS becomes 0, i.e., when the accelerator pedal is released. The control module 12 generates a brake depression signal when BPS becomes a value greater than 0, i.e., when the brake pedal 44 is depressed.

The AFD Mod. 60 receives the accelerator release signal and the BFD Mod. 62 receives the brake depression signal. In response, the AFD Mod. 60 and the BFD Mod. 62 selectively generate a fuel deactivation signal based on vehicle and engine conditions, as described in more detail below. When the control module 12 receives the fuel deactivation signal, fuel delivery is deactivated.

Figure 2:
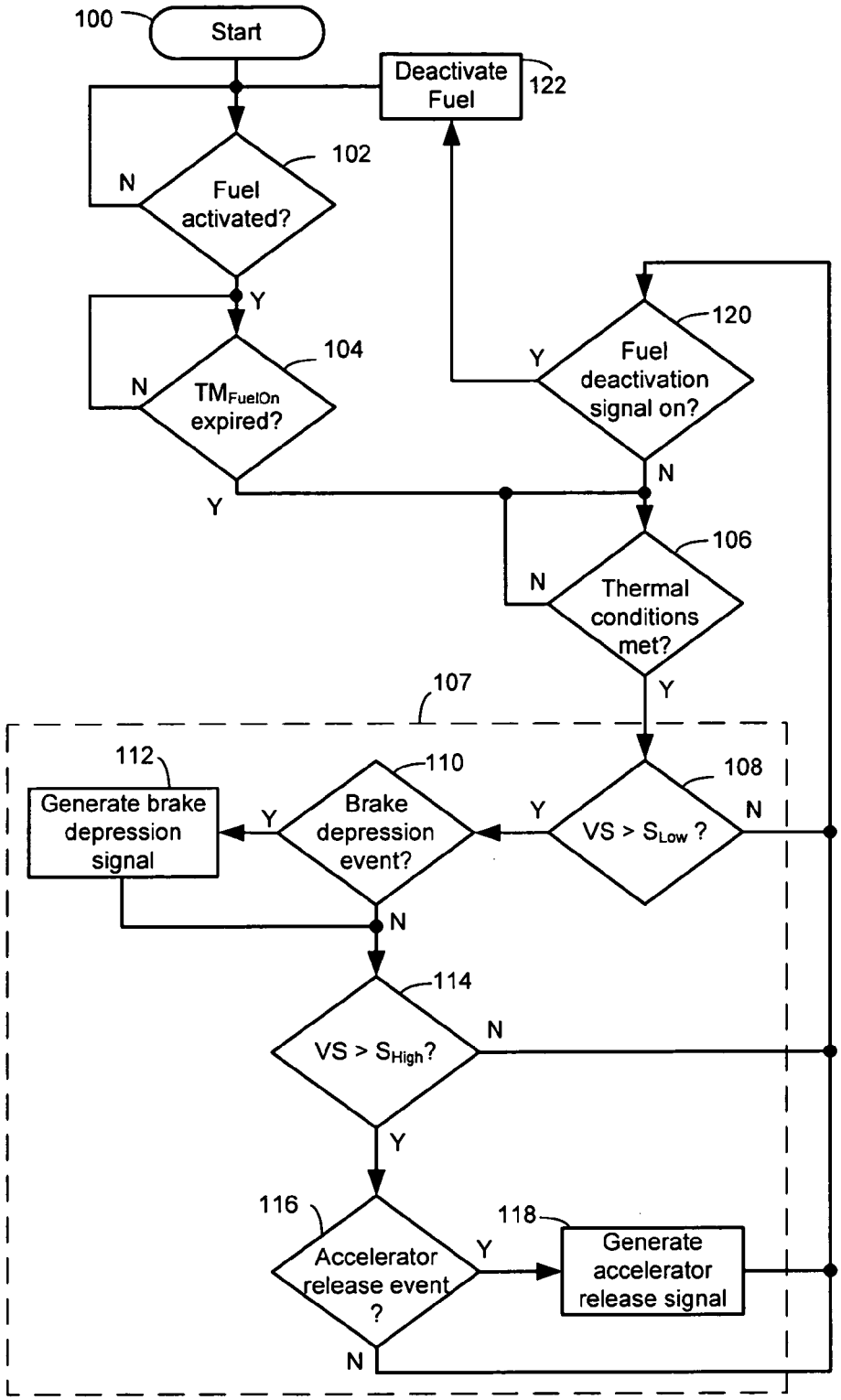
FIG. 2 is a flowchart illustrating steps performed by a fuel deactivation control system according to the present invention.

Referring now to FIG. 2, steps performed by a fuel deactivation control system according to the present invention are illustrated. Control begins with step 100. In step 102, control determines whether fuel delivery is activated. In step 102, when fuel is not activated, control loops back to step 102. Fuel is activated by depression of the accelerator pedal 40. When fuel is activated, control determines whether to deactivate fuel starting in step 104.

In step 104, control determines whether fuel delivery has been activated for longer than a predetermined fuel delivery delay period ($TM_{FuelOn}$). $TM_{FuelOn}$ starts when fuel is activated. When fuel delivery is deactivated, $TM_{FuelOn}$ is reset and starts again when fuel delivery is activated. In step 104, when $TM_{FuelOn}$ has not expired, control loops back to step 104. In this way, an event signal is not generated until after $TM_{FuelOn}$ has expired. Consequently, fuel delivery deactivation does not occur until after $TM_{FuelOn}$ has expired.

When $TM_{FuelOn}$ expires, control determines whether predetermined thermal conditions have been met in step 106. The thermal conditions are a function of $T_{Amb}$. The thermal conditions are met when:

$T_{Amb}$ is within a predetermined ambient temperature range;

$T_{Eng}$ is greater than a minimum engine temperature; and $T_{Trans}$ is greater than a minimum transmission temperature;

where the minimum engine temperature and minimum transmission temperature are a function of $T_{Amb}$.

When the thermal conditions have been met, control proceeds to an event signal generation routine 107. In an alternate embodiment, control may proceed when a predetermined subset or combination of thermal conditions have been met. When the thermal conditions have not been met, control loops back to step 106. In this way, an event signal is not generated, and fuel delivery is not deactivated, until after the thermal conditions have been met.

Depending on VS, an event signal may be a result of an accelerator release event or a brake depression event. An accelerator release event occurs when APS changes to 0, i.e., when the accelerator pedal 40 is released. After the accelerator pedal 40 is released, APS may remain at 0, however, the accelerator release event only occurs when APS initially changes to 0. Likewise, a brake depression event occurs when BPS changes to a value greater than 0 (or a predetermined value), i.e., when the brake pedal 44 is depressed. After the brake pedal 44 is depressed, BPS may remain greater than 0, however, the brake depression event only occurs when BPS initially changes to a value greater than 0.

Control enters the event signal generation routine 107 and determines whether VS is greater than a predetermined low speed ($S_{Low}$) in step 108. An event signal is only generated when VS is greater than $S_{Low}$. When VS is not greater than $S_{Low}$, control exits the event signal generation routine 107 and proceeds to step 120. When VS is greater than $S_{Low}$, control determines whether a brake depression event has occurred in step 110. When a brake depression event has occurred, control generates a brake depression signal in step 112. The brake depression signal is received by the BFD Mod. 62, as described below. After generating the brake depression signal in step 112, control proceeds to step 114.

In step 114 control determines whether VS is greater than a predetermined high speed ($S_{High}$). When VS is greater than $S_{High}$, an event signal may be the result of an accelerator release event. When VS is not greater than $S_{High}$, control exits the event signal generation routine. When VS is greater than $S_{High}$, control determines whether an accelerator release event has occurred in step 116. When an accelerator release event has occurred in step 116, control generates an accelerator release signal in step 118. The accelerator release signal is received by the AFD Mod. 60, as described below. After generating the accelerator release signal in step 118, control exits the event signal generation routine 107 and proceeds to step 120. Likewise, when an accelerator release event has not occurred, control exits the event signal generation routine 107 and proceeds to step 120.

In this way, when VS is greater than $S_{High}$, control checks for both a brake depression event and an accelerator release event. When VS is between $S_{High}$ and $S_{Low}$, control checks for a brake depression event only. When VS is greater than $S_{High}$, a release of the accelerator pedal followed by a depression of the brake pedal will generate a brake depression signal and an accelerator release signal, which are processed as described in more detail below. The brake depression event and the accelerator release event may occur in separate iterations of the event signal generation routine 107.

In step 120, control determines whether a fuel deactivation signal is on. In step 120 when the fuel deactivation signal is on, control deactivates fuel in step 122, and proceeds to step 102. In step 120 when the fuel deactivation signal is not on, control proceeds to step 106 and, when the thermal conditions are met, to the event signal generation routine 107.

Figure 5:
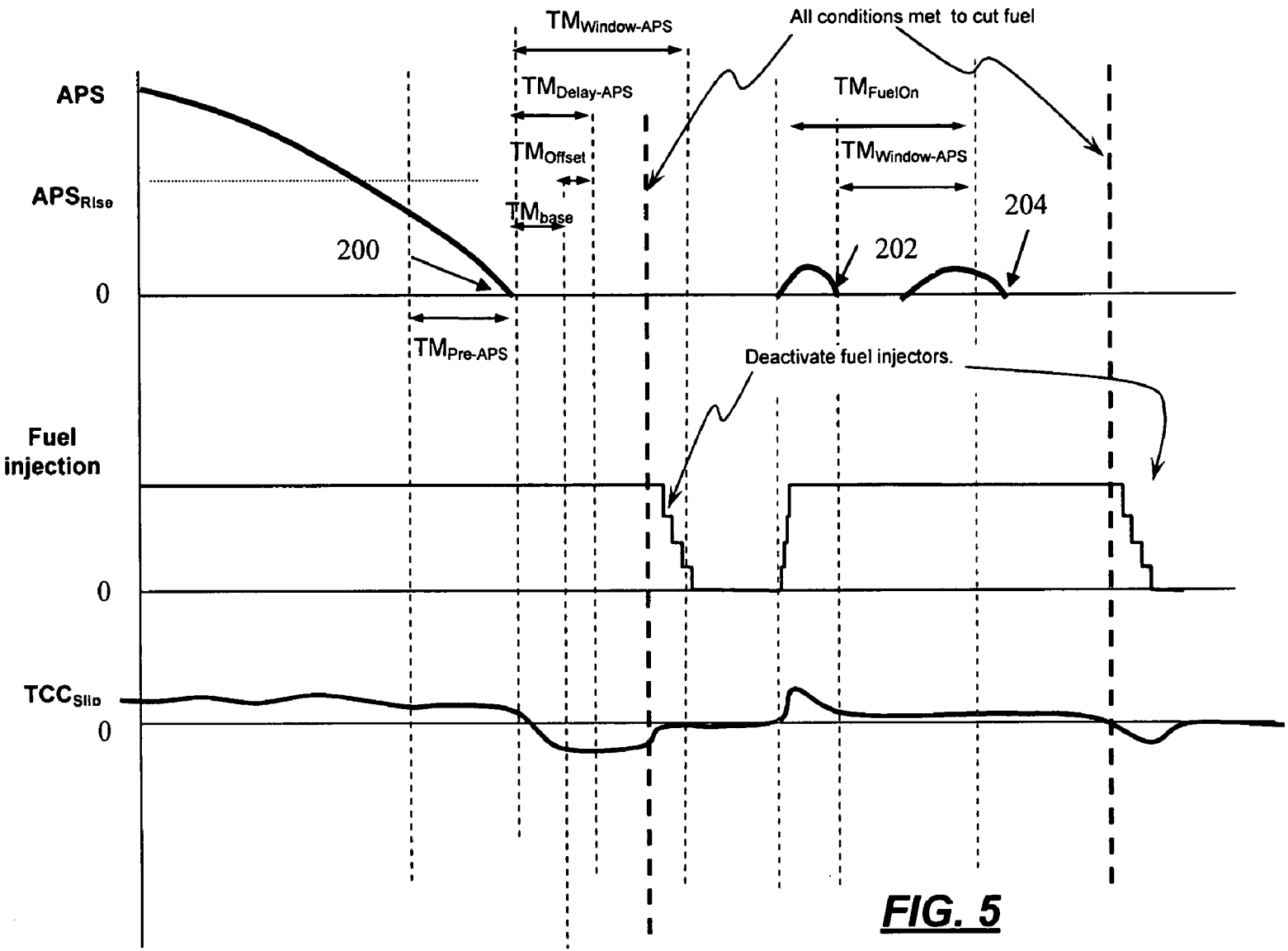
FIG. 5 is a time graph illustrating fuel deactivation.

Fuel is deactivated in step 122 by deactivating the fuel injectors one by one. Control pauses a calculated number of engine cycles in between each fuel injector deactivation. The number of pause cycles is a function of ERPM and VS, such that the number of pause cycles decreases as ERPM and VS increase. Referring now to FIG. 5, as discussed in more detail below, deactivation of four fuel injectors is shown. When all of the fuel injectors have been deactivated, control loops back to step 102.

Figure 3:
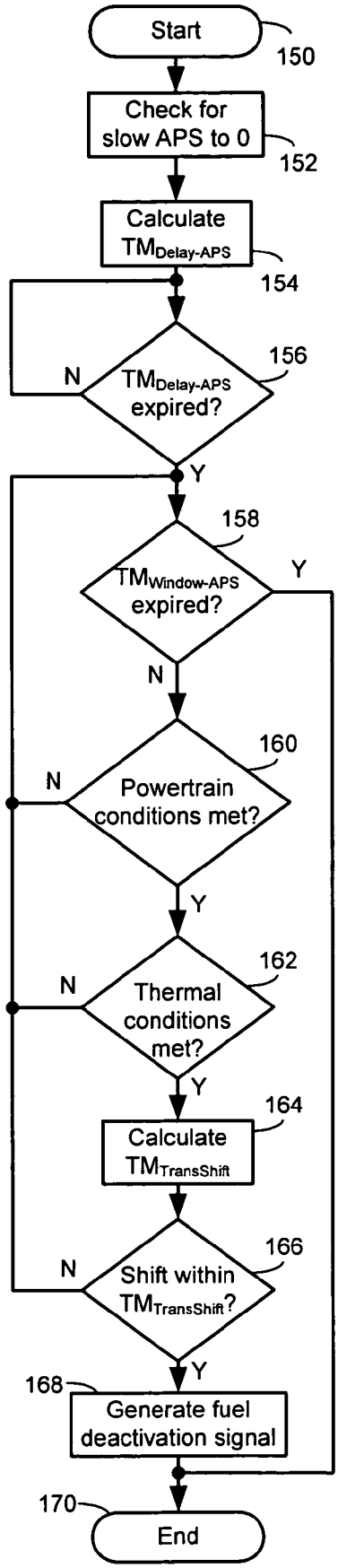
FIG. 3 is a flowchart illustrating steps performed to generate a fuel deactivation signal in response to an accelerator release signal.

Referring now to FIG. 3, steps for generating the fuel deactivation signal in response to the accelerator release signal are shown starting with step 150. The steps represented in FIG. 3 correspond to those performed by the AFD Mod. 60 shown in FIG. 1 in response to the accelerator release signal generated by the control module in step 118 shown in FIG. 2.

In step 152, control checks for a slow accelerator pedal 40 release, i.e., a slow APS to 0. Control determines an accelerator pedal release rate based on APS. APS is buffered such that control may refer to a prior APS value at a predetermined period ($TM_{Pre\text{-}APS}$) prior to the accelerator release event. In step 152, control references the buffered APS value to determine the APS value at $TM_{Pre\text{-}APS}$ prior to the accelerator release event. When the APS value at $TM_{Pre\text{-}APS}$ is less than a predetermined APS threshold ($APS_{Rise}$) the accelerator release is classified as a slow release. When the APS value at $TM_{Pre\text{-}APS}$ is not less than $APS_{Rise}$, then the release is classified as a normal release.

Referring to the graph of FIG. 5, the accelerator pedal is released at 200, and the APS value at $TM_{Pre\text{-}APS}$ prior to the release is less than $APS_{Rise}$. In such case, the accelerator pedal is classified as a slow release. When the accelerator pedal is released slowly, the driver may desire to maintain a cruising speed without decelerating, and a longer fuel deactivation delay period is calculated as described below.

Referring again to FIG. 3, control calculates an accelerator release delay period ($TM_{Delay\text{-}APS}$) in step 154. When the accelerator release event corresponds to a slow accelerator pedal release, $TM_{Delay\text{-}APS}$ is calculated as the sum of $TM_{Base}$ and $TM_{Offset}$, where $TM_{Base}$ and $TM_{Offset}$ are each a function of VS and ERPM. $TM_{Base}$ and $TM_{Offset}$ decrease as VS and ERPM increase and may be determined from a look up table. When the accelerator release event corresponds to a normal accelerator pedal release, $TM_{Delay\text{-}APS}$ is equal to $TM_{Base}$. In this way, $TM_{Delay}$ is longer for a slow accelerator pedal release.

$TM_{Delay\text{-}APS}$ starts when the accelerator release event occurs. Thus, $TM_{Delay\text{-}APS}$ starts when the AFD Mod. 60 receives the accelerator release signal. In step 156, control determines whether $TM_{Delay\text{-}APS}$ has expired. When in step 156 $TM_{Delay\text{-}APS}$ has not expired, control loops to step 156. When $TM_{Delay\text{-}APS}$ expires, control proceeds to step 158. In this way, the fuel deactivation signal is generated, if at all, after $TM_{Delay\text{-}APS}$ expires.

When $TM_{Delay\text{-}APS}$ expires, control determines whether a predetermined accelerator release window period ($TM_{Window\text{-}APS}$) has expired in step 158. $TM_{Window\text{-}APS}$ starts when the accelerator release event occurs. Thus, $TM_{Window\text{-}APS}$ starts when the AFD Mod. 60 receives the accelerator release signal. For a fuel deactivation signal to be generated as a result of an accelerator release event, all of the conditions for fuel deactivation must occur within $TM_{Window\text{-}APS}$. In step 158, when $TM_{Window\text{-}APS}$ expires, control ends in step 170. In this way, the conditions for fuel delivery deactivation must be met after $TM_{Delay\text{-}APS}$ expires and before $TM_{Window\text{-}APS}$ expires. When the conditions are not met within that period, fuel delivery is not deactivated as a result of the present accelerator release signal.

In step 158, when $TM_{Window\text{-}APS}$ has not expired, control determines whether powertrain conditions have been met in step 160. The powertrain conditions are met when:

- ERPM is less than a predetermined maximum engine speed;
- MAP is less than a predetermined maximum manifold pressure;
- the spark offset amount is greater than a predetermined minimum spark offset; and
- either the torque converter is in a lock state, or the $TCC_{Slip}$ is within a predetermined TCC slip range.

Control may determine that whether $TCC_{Slip}$ is within a predetermined TCC slip range by calculating an absolute value of $TCC_{Slip}$ and determining whether the absolute value of $TCC_{Slip}$ is less than a predetermined TCC Slip maximum.

When the powertrain conditions have been met, control proceeds to step 162. In an alternate embodiment, control may proceed when a subset or combination of the powertrain conditions have been met. When the powertrain conditions have not been met, control proceeds to step 158.

In step 162, control determines whether thermal conditions have been met. The thermal conditions checked in step 162 are the same as the thermal conditions checked in step 106 shown in FIG. 2 and discussed above. When the thermal conditions are not met, control loops back to step 158. In step 162, when the thermal conditions are met, control proceeds to step 164.

In step 164, control calculates a transmission-shift free period ($TM_{TransShift}$) based on ERPM and VS. $TM_{TransShift}$ decreases as ERPM and VS increase. Prior to fuel deactivation the transmission must not have been shifted for a time period at least equal to $TM_{TransShift}$. In step 166, control determines whether there has been a transmission shift within the $TM_{TransShift}$ time period. Control may monitor a transmission-shift timer that is reset when the transmission is shifted. Control may determine that the transmission has not been shifted within the $TM_{TransShift}$ period when the transmission shift timer is greater than $TM_{TransShift}$.

When in step 166, the transmission 32 has been shifted within $TM_{TransShift}$, control loops to step 158. When in step 166 the transmission 32 has not been shifted within $TM_{TransShift}$, all of the conditions for generating the fuel deactivation signal have been met, and control proceeds to step 168. It is understood that the conditions shown in FIG. 3 may be checked in a different order.

In step 168, control generates the fuel deactivation signal. Control ends in step 170.

Figure 4:
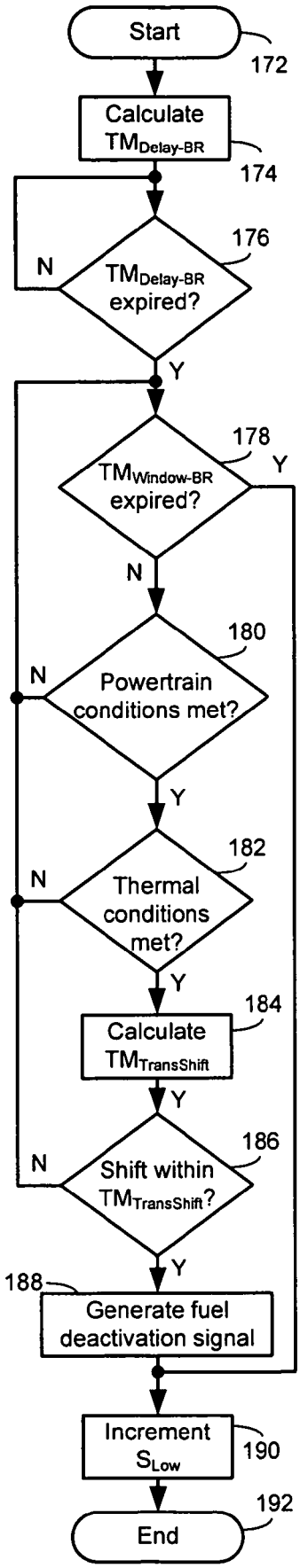
FIG. 4 is a flowchart illustrating steps performed to generate a fuel deactivation signal in response to a brake depression signal.

Referring now to FIG. 4, steps for generating the fuel deactivation signal in response to the brake release signal are shown starting with step 172. The steps represented in FIG. 4 correspond to those performed by the BFD Mod. 62 shown in FIG. 1 in response to the brake depression signal generated by the control module in step 112 shown in FIG. 2. In step 174, control calculates a brake depression delay period ($TM_{Delay-BR}$). $TM_{Delay-BR}$ is equal to $TM_{Base}$, which decreases as VS and ERPM increase. As discussed above, $TM_{Base}$ may be determined from a look up table.

$TM_{Delay-BR}$ starts when the brake depression event occurs. Thus, $TM_{Delay-BR}$ starts when the BFD Mod. 60 receives the brake depression signal. In step 176 control determines whether $TM_{Delay-BR}$ has expired. When in step 156 $TM_{Delay-BR}$ has not expired, control loops to step 176. When $TM_{Delay-BR}$ expires, control proceeds to step 178. In this way, the fuel deactivation signal is generated, if at all, after $TM_{Delay-BR}$ expires.

When $TM_{Delay-BR}$ expires, control determines whether a predetermined brake depression window period ($TM_{Window-BR}$) has expired in step 178. $TM_{Window-BR}$ starts when the brake depression event occurs. Thus, $TM_{Window-BR}$ starts when the BFD Mod. 60 receives the brake depression signal. For a fuel deactivation signal to be generated as a result of a brake depression event, all of the conditions for fuel deactivation must occur within $TM_{Window-BR}$. In step 178, when $TM_{Window-BR}$ expires, control proceeds to step 190. In this way, the conditions must be met after $TM_{Delay-BR}$ expires and before $TM_{Window-BR}$ expires. When the conditions are not met within that time period, the fuel delivery is not deactivated as a result of the present brake release signal.

In step 178, when $TM_{Window-BR}$ has not expired, control determines whether powertrain conditions have been met in step 180. The powertrain conditions checked in step 180 are the same as those described in step 160, shown in FIG. 3, and discussed above. When the powertrain conditions have not been met, control proceeds to step 178.

When the powertrain conditions have been met in step 180, control determines whether thermal conditions have been met in step 182. The thermal conditions in step 182 are the same as those described in steps 162 shown in FIG. 3, and step 106 shown in FIG. 2, and discussed above. When the thermal conditions are not met, control loops back to step 178. In step 182, when the thermal conditions are met, control proceeds to step 184.

In step 184, control calculates $TM_{TransShift}$ based on ERPM and VS. Step 184 corresponds to step 164 shown in FIG. 3 and discussed above. In step 186, control determines whether the transmission has been shifted within the $TM_{TransShift}$ time period. When in step 186, the transmission 32 has been shifted within $TM_{TransShift}$, control loops to step 178.

When in step 186 the transmission 32 has not been shifted within $TM_{TransShift}$, all of the conditions for generating the fuel deactivation signal have been met, and control proceeds to step 188. It is understood that the conditions shown in FIG. 4 may be checked in a different order. In step 188, control generates the fuel deactivation signal.

Control then proceeds to step 190. Initially, $S_{High}$ and $S_{Low}$ are predetermined initial values such as 20 miles per hour and 12 miles per hour, respectively. $S_{Low}$, however, is incremented in step 190 by a predetermined amount each time the brake depression event occurs. $S_{Low}$ remains at the incremented value until another brake depression event occurs. Then, $S_{Low}$ is incremented again. $S_{Low}$ is incremented in this manner until $S_{Low}$ and $S_{High}$ are equal. When fuel delivery is activated for a predetermined period, $S_{Low}$ is reset to the initial value. In this way, when the driver repeatedly depresses and releases the brake, $S_{Low}$ is incremented such that fuel delivery deactivation does not occur at the same VS.

For example, when the driver is slowly searching for an empty parking spot, the driver may maneuver the parking lot and repeatedly depress and release the brake pedal. In such case, control increments $S_{Low}$ such that fuel deactivation does not repeatedly occur. After incrementing $S_{Low}$ in step 190, control ends in step 192.

Referring now to FIG. 5, a graphic illustration of APS, fuel injection, and $TCC_{Slip}$ versus time is shown. APS goes to 0 three times resulting in three accelerator release signals at 200, 202, 204. Fuel is deactivated on the first and the last accelerator releases 200, 204. On the first accelerator release 200, the back referenced APS at $TM_{Pre-APS}$ is less than $APS_{Rise}$. Thus, the accelerator pedal release is classified as a slow release and $TM_{Delay-APS}$ is calculated as the sum of $TM_{Base}$ and $TM_{Offset}$.

All of the conditions for fuel deactivation are met within the period $TM_{Window-APS}$ after the first accelerator release 200 and fuel delivery is deactivated. When fuel delivery is deactivated, the fuel injectors are deactivated one-by-one in a step down fashion, with intervening engine cycles in between each fuel injector deactivation. On the second accelerator release 202, $TM_{FuelOn}$ has not yet expired. Thus, fuel delivery is not deactivated as a result of the second accelerator release. On the third accelerator release 204, $TM_{FuelOn}$ has expired. All of the conditions for fuel deactivation are met and fuel delivery is deactivated.

Figure 6:
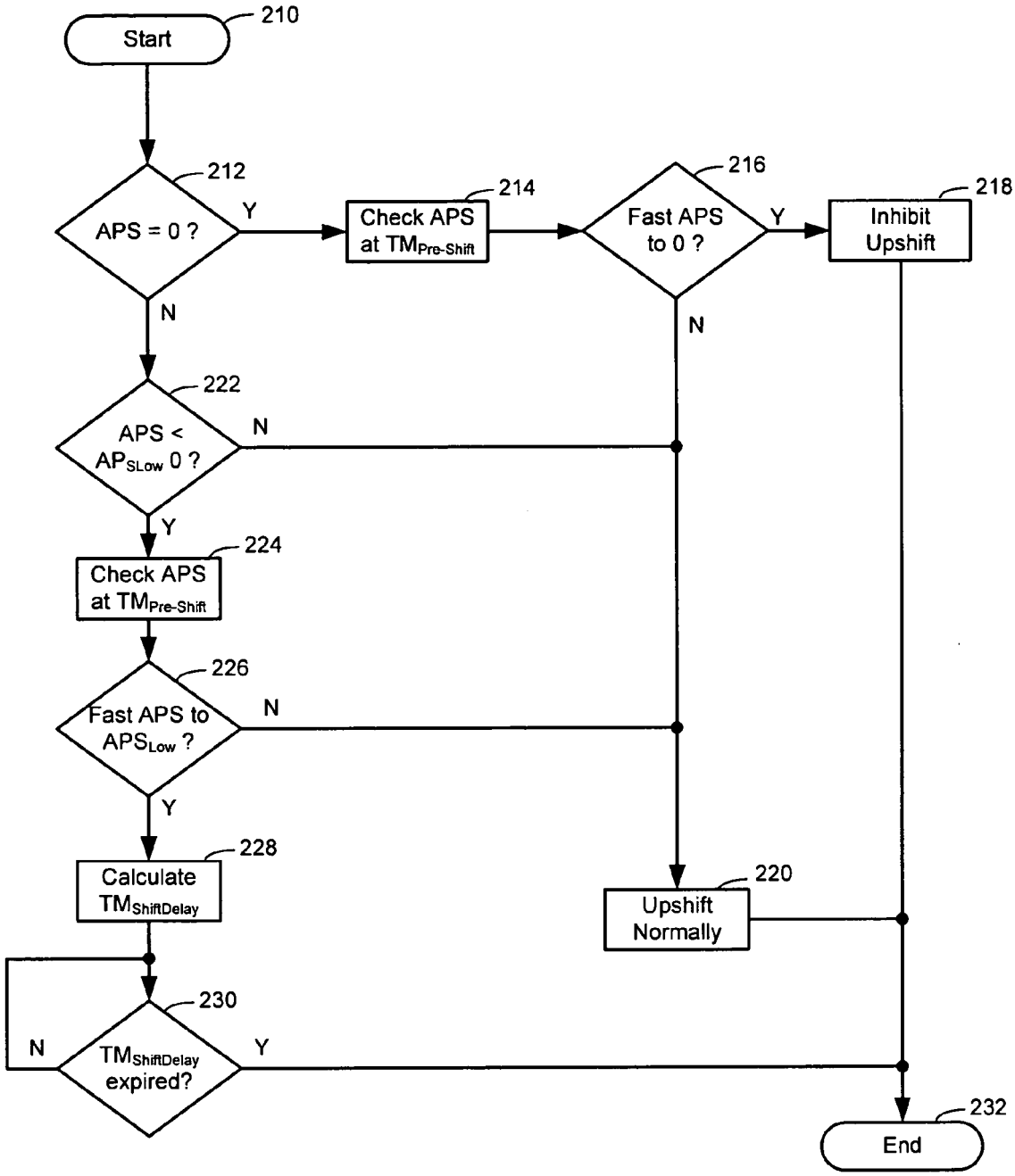
FIG. 6 is a flowchart illustrating steps performed to inhibit a transmission up-shift.

Referring now to FIG. 6, steps to inhibit a transmission up-shift according to the present invention are illustrated starting with step 210. The routine described in FIG. 5 is called prior to a transmission up-shift. In step 212, control determines whether APS equals 0. When in step 212 APS equals 0, control checks a back referenced APS position at $TM_{Pre\text{-}Shift}$ in step 214. In step 216, control determines whether the accelerator pedal has been a fast release.

When the back referenced APS value is greater than a predetermined fast release threshold, the release may be characterized as a fast release. When control determines that there has been a fast release, or fast APS to 0, then the upshift is inhibited in step 218 and control ends in step 232. In this way, the transmission upshift is inhibited when the accelerator pedal release is a fast.

When the accelerator pedal is released fast to an APS of 0, deceleration resulting in fuel deactivation is likely to occur. By inhibiting the upshift, control prevents additional driveline disturbance caused by the up-shift and immediate downshift when the fuel is deactivated. Additionally, fuel deactivation may occur sooner than it would if the up-shift had been allowed. When in step 216, there has not been a fast accelerator pedal release, control allows the up-shift to occur normally in step 220.

When in step 212 APS is not equal to 0, control determines whether there has been a near-release of the accelerator pedal by determining whether APS is less than a predetermined low APS value ($APS_{Low}$) in step 222. When in step 222, APS is not less than $APS_{Low}$, control allows the up-shift to proceed normally in step 220. When APS is less than $APS_{Low}$, control back references the APS at $TM_{Pre\text{-}Shift}$ in step 224. Control then determines whether there has been a fast near-release of the accelerator pedal to the current low APS in step 226. When there has been a fast near-release in step 226, control calculates a transmission shift delay time ($TM_{ShiftDelay}$) in step 228. $TM_{ShiftDelay}$ is a function of VS and ERPM such that $TM_{ShiftDelay}$ decreases as ERPM and VS increase. Control loops on step 230 until $TM_{ShiftDelay}$ expires. When $TM_{ShiftDelay}$ expires, control ends in step 232. In this way, the transmission up-shift, if any, has been delayed. After control ends in step 232, when the conditions are such that a transmission up-shift is still required, then the routine will be called again, and control will determine whether to allow the up-shift to proceed as described above.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. A fuel delivery control system in a vehicle having an engine, an accelerator pedal, and a brake pedal, said fuel delivery control system comprising:

a vehicle speed sensor that generates a vehicle speed signal;

an engine rotational speed sensor that generates an engine rotational speed signal; and a control module that calculates at least one of an accelerator release delay period and a brake depression delay period based on said vehicle speed signal and said engine rotational speed signal and deactivates fuel delivery to said engine after waiting at least one of said accelerator release delay period after said accelerator pedal is released and said brake depression delay period after said brake pedal is depressed.

2. The fuel delivery control system of claim 1 wherein said control module deactivates fuel delivery after waiting a predetermined fuel delivery delay period after fuel delivery to said engine is activated.

3. The fuel delivery control system of claim 1 wherein said control module deactivates fuel delivery during at least one of a predetermined accelerator release window period after said accelerator pedal is released and a predetermined brake depression window period after said brake pedal is depressed.

4. The fuel delivery control system of claim 1 further comprising an ambient temperature sensor that generates an ambient temperature signal wherein said control module deactivates fuel delivery when said ambient temperature signal is within a predetermined ambient temperature range.

5. The fuel delivery control system of claim 4, further comprising an engine temperature sensor that generate an engine temperature signal, wherein said control module calculates a minimum engine temperature based on said ambient temperature signal and deactivates fuel delivery when said engine temperature signal is greater than said minimum engine temperature.

6. The fuel delivery control system of claim 4, said vehicle having a transmission, further comprising a transmission temperature sensor that generates a transmission temperature signal, wherein said control module calculates a minimum transmission temperature based on said ambient temperature signal and deactivates fuel delivery when said transmission temperature signal is greater than said minimum transmission temperature.

7. The fuel delivery control system of claim 6 wherein said control module calculates a shift-free period based on said vehicle speed signal and said engine rotational speed signal and deactivates fuel delivery after waiting said shift-free period after said transmission is shifted.

8. The fuel delivery control system of claim 1 wherein said control module deactivates fuel delivery when said engine rotational speed signal is less than a predetermined maximum engine speed.

9. The fuel delivery control system of claim 1, said vehicle having an intake manifold, further comprising an intake manifold pressure sensor that generates an intake manifold pressure signal, wherein said control module deactivates fuel delivery when said intake manifold pressure signal is less than a predetermined maximum manifold pressure.

10. The fuel delivery control system of claim 1, said vehicle having a torque converter with a torque converter clutch, further comprising a transmission input shaft rotational speed sensor that generates a transmission input shaft rotational speed signal, wherein said control module calculates a torque converter clutch slip based on said engine rotational speed signal and said transmission input shaft rotational speed signal, monitors a state of said torque converter clutch, and deactivates fuel delivery when at least one of said torque converter clutch is in a lock state and said calculated torque converter clutch slip is within a predetermined slip range.

11. The fuel delivery control system of claim 1, said vehicle having an ignition system, wherein said control module monitors a spark offset of said ignition system and deactivates fuel delivery when said spark offset is greater than a predetermined minimum spark offset.

12. A fuel delivery control system in a vehicle having an engine, an accelerator pedal, and a brake pedal, said fuel delivery control system comprising:

a vehicle speed sensor that generates a vehicle speed signal;

an engine rotational speed sensor that generates an engine rotational speed signal;

a control module that calculates an accelerator release delay period and a brake depression delay period based on said vehicle speed signal and said engine rotational speed signal, deactivates fuel delivery to said engine after waiting said accelerator release delay period after said accelerator pedal is released when said vehicle speed signal is greater than a predetermined high vehicle speed, and deactivates fuel delivery to said engine after waiting said brake release delay period after said brake pedal is released when said vehicle speed signal is greater than a predetermined low vehicle speed.

13. The fuel delivery control system of claim 12 wherein said control module calculates an incremented low vehicle speed based on said predetermined low vehicle speed when said brake pedal is depressed and deactivates fuel delivery to said engine after waiting said brake release delay period when said vehicle speed signal is greater than said incremented low vehicle speed.

14. The fuel delivery control system of claim 12 further comprising an accelerator position sensor that generates an accelerator position signal, wherein said control module determines an accelerator pedal release rate based on said accelerator position signal and increases said accelerator release delay period when said accelerator pedal release rate is less than a predetermined release rate.

15. The fuel delivery control system of claim 14 wherein said control module stores a prior accelerator position signal and determines said accelerator pedal release rate based on said prior accelerator position signal.

16. A method for deactivating fuel delivery in a vehicle having a transmission and an accelerator pedal, said method comprising:

determining a vehicle speed and an engine rotational speed;

classifying an accelerator pedal release as one of a fast release and a normal release;

inhibiting an up-shift of said transmission when said accelerator pedal release is classified as said fast release;

calculating a shift-free delay period based on said vehicle speed and said engine rotational speed; and deactivating fuel delivery after waiting said shift-free delay period after said transmission is shifted.

17. The method of claim 16 wherein said classifying said accelerator pedal release comprises:

determining a prior position of said accelerator pedal at a predetermined period before said accelerator pedal release; and classifying said accelerator pedal release as said fast release when said prior position is greater than a predetermined accelerator position.

18. The method of claim 16, said vehicle including an engine and said method further comprising:

classifying an accelerator pedal near-release as one of a fast near-release and a normal near-release;

calculating a shift-delay period based on said engine rotational speed and said vehicle speed;

delaying an up-shift of said transmission for said shift-delay period when said accelerator pedal near-release is classified as said fast near-release.

19. The method of claim 16, said vehicle having a brake pedal, said method further comprising:

calculating at least one of an accelerator release delay period and a brake depression delay period based on said vehicle speed and said engine rotational speed; and deactivating fuel delivery to said engine after waiting at least one of said accelerator release delay period after said accelerator pedal is released and said brake depression delay period after said brake pedal is depressed.

20. The method of claim 19 wherein said deactivating fuel delivery occurs after waiting a predetermined fuel delivery delay period after fuel delivery to said engine is activated.

* * * * *